US010024204B2

(12) United States Patent
Thielen et al.

(10) Patent No.: US 10,024,204 B2
(45) Date of Patent: Jul. 17, 2018

(54) CAMSHAFT ADJUSTER INCLUDING A DISCHARGE VALVE

(71) Applicant: Schaeffler Technologies AG & Co. KG, Herzogenaurach (DE)

(72) Inventors: Jochen Thielen, Nuremberg (DE); Olaf Boese, Nuremberg (DE); Torsten Zschieschang, Hagenbuechach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 103 days.

(21) Appl. No.: 15/302,102

(22) PCT Filed: Jan. 16, 2015

(86) PCT No.: PCT/DE2015/200005

§ 371 (c)(1),
(2) Date: Oct. 5, 2016

(87) PCT Pub. No.: WO2015/154756

PCT Pub. Date: Oct. 15, 2015

(65) Prior Publication Data

US 2017/0114677 A1 Apr. 27, 2017

(30) Foreign Application Priority Data

Apr. 7, 2014 (DE) ..... 10 2014 206 620

(51) Int. Cl.
*F01L 1/46* (2006.01)
*F01L 1/344* (2006.01)

(52) U.S. Cl.
CPC ..... *F01L 1/3442* (2013.01); *F01L 1/46* (2013.01); *F01L 2001/34426* (2013.01);
(Continued)

(58) Field of Classification Search
CPC ... F01L 2001/34423; F01L 2001/34426; F01L 2001/34433; F01L 2001/34453; F01L 2001/34469; F01L 1/46
(Continued)

(56) References Cited

U.S. PATENT DOCUMENTS 6,418,897 B1 7/2002 Urben et al.
6,481,402 B1 * 11/2002 Simpson ..... F01L 1/022 123/90.12

(Continued)

FOREIGN PATENT DOCUMENTS

CN 102337942 2/2012
CN 102356215 2/2012

(Continued)

*Primary Examiner* — Jorge Leon, Jr.
(74) *Attorney, Agent, or Firm* — Davidson, Davidson & Kappel, LLC

(57) ABSTRACT

A hydraulic camshaft adjuster (1), in particular a vane-type hydraulic camshaft adjuster, including a rotor (2) and a stator (3) which are mounted to rotate with respect to each other, a cover (10) fixed on the stator (3), including a locking receiver and at least one locking pin (11, 12) accommodated in the rotor (2), the locking pin being slidable in the axial direction and prestressed in the direction of the locking receiver, and a hydraulic channel (27, 28, 29) to apply pressure of the locking pin (11, 12) against the prestress of same, the hydraulic channel being able to be filled and emptied with a hydraulic medium via a central screw, wherein in the rotor (2) at least one additional discharge channel (37, 38, 39, 40) fluidically connected to the hydraulic channel (27, 28, 29) is formed with a discharge valve (33, 34, 35, 36), wherein preferably the discharge valve (33, 34, 35, 36) closes the discharge channel (37, 38, 39, 40) when the locking pin (11, 12) is pressurized and opens the discharge channel when the hydraulic pressure acting on the locking pin (11, 12) falls.

8 Claims, 3 Drawing Sheets

(52) U.S. Cl.
CPC ..... *F01L 2001/34433* (2013.01); *F01L 2001/34453* (2013.01); *F01L 2001/34469* (2013.01)

(58) Field of Classification Search
USPC ..... 123/90.17
See application file for complete search history.

(56) References Cited

U.S. PATENT DOCUMENTS

| | | | | |
|---|---|---|---|---|
| 8,360,022 | B2 | 1/2013 | Ozawa et al. | |
| 8,640,662 | B2 | 2/2014 | Cole et al. | |
| 8,677,965 | B2 | 3/2014 | Kato et al. | |
| 8,683,966 | B2 | 4/2014 | Busse et al. | |
| 2002/0078913 | A1 | 6/2002 | Fukuhara et al. | |
| 2011/0017156 | A1* | 1/2011 | Smith | F01L 1/3442 123/90.15 |
| 2013/0220253 | A1* | 8/2013 | Pluta | F01L 1/3442 123/90.17 |
| 2017/0022854 | A1* | 1/2017 | Takada | F01L 1/3442 |

FOREIGN PATENT DOCUMENTS

| | | | |
|---|---|---|---|
| DE | 19856318 | | 6/2000 |
| DE | 19908934 | A1 | 9/2000 |
| DE | 102005024242 | A1 | 12/2006 |
| DE | 102008036877 | | 2/2010 |
| EP | 1849967 | | 10/2007 |
| WO | WO 2003049617 | | 2/2003 |
| WO | WO02012/061233 | | 5/2012 |
| WO | WO02012/094324 | | 7/2012 |

* cited by examiner

CAMSHAFT ADJUSTER INCLUDING A DISCHARGE VALVE

The present invention relates to a hydraulic camshaft adjuster, in particular a hydraulic camshaft adjuster of the vane cell type, which includes a rotor and a stator which are supported in such a way that they are rotatable relative to one another, a cover which is fixed to the stator and which includes a locking receptacle, a locking pin which is accommodated in the rotor in such a way that the locking pin is displaceable in the axial direction, and is pretensioned in the direction of the locking receptacle, and a hydraulic channel for acting with pressure on the locking pin against its pretension, it being possible to fill the hydraulic channel with a hydraulic medium and empty same via a central screw.

BACKGROUND

Camshaft adjusters are used for a targeted adjustment of the phase position between a camshaft and a crankshaft in an internal combustion engine. They allow an optimized setting of valve timing via the engine load and the engine speed. In this way, fuel consumption and exhaust gas emissions may be significantly reduced and the power of the engine may be increased.

A camshaft adjuster is generally made up of a stator, a rotor positioned in the stator, and two sealing covers. A number of pressure chambers, also referred to as vane chambers, are formed in the stator, and are separated from one another by webs which extend radially inwardly away from the stator wall. Rotor vanes of the rotor which is mounted within the stator engage with the pressure chambers. For adjustment of the camshaft, the pressure chambers are acted on by hydraulic medium, as the result of which the rotor is rotated within the stator.

It is known to provide camshaft adjusters with a locking mechanism which locks the rotor relative to the stator in certain situations, for example when the engine is switched off. For this purpose, it is known to provide locking pins in a rotor which are displaceable in the axial direction and pretensioned in the direction of a locking cover. Due to their pretension, the locking pins engage with locking recesses in the locking cover fixed to the stator, so that the rotor is locked relative to the stator. The locking pins are pushed, against the pretension, from this locking position into a released position with the aid of hydraulic pressure; in the released position, the locking pins are disengaged from the locking cover, and the rotor is not blocked relative to the stator. The action of pressure on the locking pins takes place via a hydraulic channel which is formed in the rotor and which is acted on by hydraulic medium and emptied via an oil borehole. The action and/or relief of pressure in this channel is generally controlled via a switch valve. The volume flow of hydraulic medium is determined by the oil borehole.

It may now be necessary, for example when the motor vehicle engine is switched off, to lock the camshaft adjuster in its corresponding locking position within very short time periods. It is problematic that the locking pin, due to the hydraulic pressure which is reduced only relatively slowly on its high-pressure side as the result of an insufficient volume flow through the oil borehole, is not able to engage with the locking cover, against the pretension which acts against the locking pin, in the required short time.

A rotary vane adjuster is known from DE 199 08 934 A1, including a stator which is driven by the crankshaft, preferably via a traction mechanism and via a drive wheel, and a vane rotor which may be acted on by pressure oil, is in a rotatably fixed connection with the camshaft, and includes means, preferably an axially displaceable fixing pin, for a releasable rotatable fixing of the vane rotor, all components of the rotary vane adjuster which have pressure oil contact being situated in an oil-tight housing.

A hydraulic camshaft adjuster which includes a stator, a rotor, and first and second pressure medium lines is known from DE 10 2005 024 242 A1. At least one pressure chamber is formed between the stator and the rotor, each pressure chamber being divided into two oppositely acting pressure chambers by a vane that is situated or formed on the output element in a rotatably fixed manner. Pressure medium may be supplied to the first pressure chambers and discharged from same with the aid of the first pressure medium lines. Pressure medium may be supplied to the second pressure chambers and discharged from same with the aid of the second pressure medium lines. The camshaft adjuster includes a locking device having a receptacle that is formed on the rotor or the stator, a slot that is formed on the other component, a locking pin situated in the receptacle, and a spring which pushes the locking pin in the direction of the component on which the slot is formed. The locking pin engages with the slot in a defined locking position of the rotor relative to the stator, and may be pushed back into the receptacle by the action of pressure medium on the slot. At least one pressure medium connection is provided between the slot and the pressure chamber or the associated pressure medium line, which are acted on by pressure medium in order to rotate the output element out of the locking position. Each pressure means connection is implemented with the aid of exactly one pressure medium channel. The pressure medium channel is connected on the one hand to the pressure chamber or to the pressure medium line, and on the other hand to the slot. One of the two connections is established in each position of the output element with respect to the drive element. The other connection and the connection between the pressure medium channel and the locking pin are established only when the output element is in the locking position relative to the drive element.

SUMMARY OF THE INVENTION

According to the prior art, a complicated switch valve is generally necessary for suitable emptying of the hydraulic channel and relieving pressure on the locking pin. Complicated additional devices, for example a separate control channel for the locking pins, may be necessary due to the fixed cross section of the flow paths of the hydraulic medium. Relatively long flow paths and high hydraulic resistances result in relatively long pressure relief times until the camshaft adjuster is locked.

An object of the present invention is to provide a camshaft adjuster which does not have the above-mentioned disadvantages, or has them only to a lesser extent. In particular, the aim is to be able to achieve faster locking of the camshaft adjuster, in particular after the engine is switched off.

The present invention provides that at least one additional discharge channel which includes a discharge valve and which is fluidically connected to the hydraulic channel is formed in the rotor, it being innovative that the discharge valve closes the discharge channel when the locking pin is acted on by pressure, and opens the discharge channel when the hydraulic pressure acting on the locking pin drops. Due to the present invention, when there is a pressure drop, for example due to switching off the engine, at least one additional flow path is opened through which hydraulic medium may flow to the tank. The present invention yields the advantage that the pressure drop at the locking pin takes place very quickly, for example within a period of 1 second, preferably within approximately 0.6 to 0.3 seconds, particularly preferably within approximately 0.4 seconds, so that, due to the pretension acting on it, the locking pin may arrive at the position in which the rotor is locked with the cover, at the desired, required high speed.

The discharge valve may in particular be situated in the discharge channel in the rotor. The rotor preferably includes three, four, or five discharge channels, in each of which a discharge valve is situated. The locking speed of the camshaft adjuster may be increased in a particularly advantageous manner by providing an appropriate number of discharge channels and discharge valves. The camshaft adjuster may be designed with a center locking mechanism and/or with an advanced locking mechanism or retarded locking mechanism.

According to one specific embodiment, the hydraulic channel may be formed in the rotor and/or in the cover. When the discharge valve is closed, the hydraulic channel preferably forms a flow path for hydraulic medium from a supply line to the locking pin, and from the locking pin back to the supply line. In the case of an open discharge valve, the hydraulic channel forms a flow path from the supply line to the locking pin, and from the locking pin to the discharge valve, and thus to the discharge channel via the rotor, back to a tank.

According to one specific embodiment, the hydraulic channel may be designed as a ring channel/partially circular ring channel (i.e., extending over 360° or approximately 270° or 180° or 90°). The hydraulic channel may in particular lead from the supply line via the locking pin back to the supply line. The hydraulic channel is preferably formed in the front side of the rotor facing the cover. The cover preferably rests against the rotor in a sealing manner, so that the hydraulic channel is closed with the aid of the cover. Such a hydraulic channel is advantageously particularly easy and inexpensive to manufacture.

It is particularly advantageous when the shut-off valve includes a valve seat which is fixed in the rotor, and a valve body which is movable, in particular axially displaceable, with respect to the valve seat, including a flow path for hydraulic medium. When the discharge valve is open, hydraulic medium flows through the flow path, and when the valve is closed, the flow path is closed by sealing contact of the valve body on the valve seat. Such a discharge valve is simple and functions reliably and robustly.

It is also advantageous when the valve body includes a diaphragm whose axial width is less than the axial length of the valve body, and/or whose flow cross-sectional area is less than the flow cross-sectional area of the flow path. Using such a diaphragm is particularly advantageous, since the oil volume flow through the valve body is a function of the oil viscosity. A higher volume flow results at low viscosity (high temperature) than at higher viscosity (low temperature). If the valve body is designed without a diaphragm, the influence of the temperature-dependent viscosity is so great that at temperatures of approximately −30° C. it is generally not possible for sufficient hydraulic medium to flow to the tank. At the same time, at approximately 130° C. the available volume flow of the hydraulic medium is generally not sufficient to build up a sufficiently high pressure at the valve body which ensures that the valve body may be moved against the pretension force of the valve body. When a diaphragm is used, the influence of viscosity on the volume flow may be minimized, so that the desired function may be ensured at high as well as low temperatures.

The shut-off valve may include a cartridge which is fixed, in particular pressed into/joined, in the discharge channel and which forms the valve seat. In one specific embodiment, the valve body may be pretensioned into its open position, which opens the discharge channel, via a compression spring. The valve body may be pretensioned in particular with the aid of a compression spring which is supported on the cartridge. The valve body may be provided with a through hole, in particular as a hollow cylinder having a central through hole.

It is particularly advantageous when the cartridge has at least one recess, in particular a recess at the edge, which forms a flow path for hydraulic medium through the discharge channel when the shut-off valve is open. Such a cartridge is easy to manufacture, and easy to install in the discharge channel with formation of a flow path along the cartridge.

The camshaft adjuster according to the present invention is particularly suited for control drives, chain drives, and belt drives, in particular in the automotive field. Provided in the stator are a number of vane cells, for example three, four, five, or more vane cells, which are separated from one another by webs or stator segments which extend radial inwardly away from the stator wall. Rotor vanes of the rotor held within the stator engage with the vane cells.

The stator in the installed state may be connected to a crankshaft in a rotatably fixed manner. The rotor may be connected to a camshaft in a rotatably fixed manner. The torsion angle of the rotor may be delimited by the webs in the stator. The rotor and stator may be manufactured in particular without cutting. They may be cold-formed, in particular deep-drawn sheet metal components or sheet steel components. Sinter features are still possible and plausible. Such components are advantageously cost-effective and well suited for mass production. The stator may be designed in particular as a spur gearing component which includes external teeth facing outwardly in the radial direction.

It is particularly advantageous when the cover rests against the stator and/or the rotor, sealing off the vane cells directly or indirectly. The cover has at least one locking recess (locking hole), which may be designed as a through hole which passes through in the direction of the rotation axis, or as a blind hole. In the case of a through locking recess, it may be closed in a particularly advantageous manner with a bushing, a sleeve, or a plug. The connection of the locking bushing and the locking cover may be designed as an integrally bonded, force-fit, and/or form-fit connection, in particular glued, pressed, welded, screwed, etc. The cover may also be manufactured as a one-part locking cover by sintering, shaping, forging, for example, or as a cast part, etc.

BRIEF DESCRIPTION OF THE DRAWINGS

The present invention is explained in greater detail below with reference to exemplary embodiments, with the aid of drawings.

DETAILED DESCRIPTION

Figure 1:
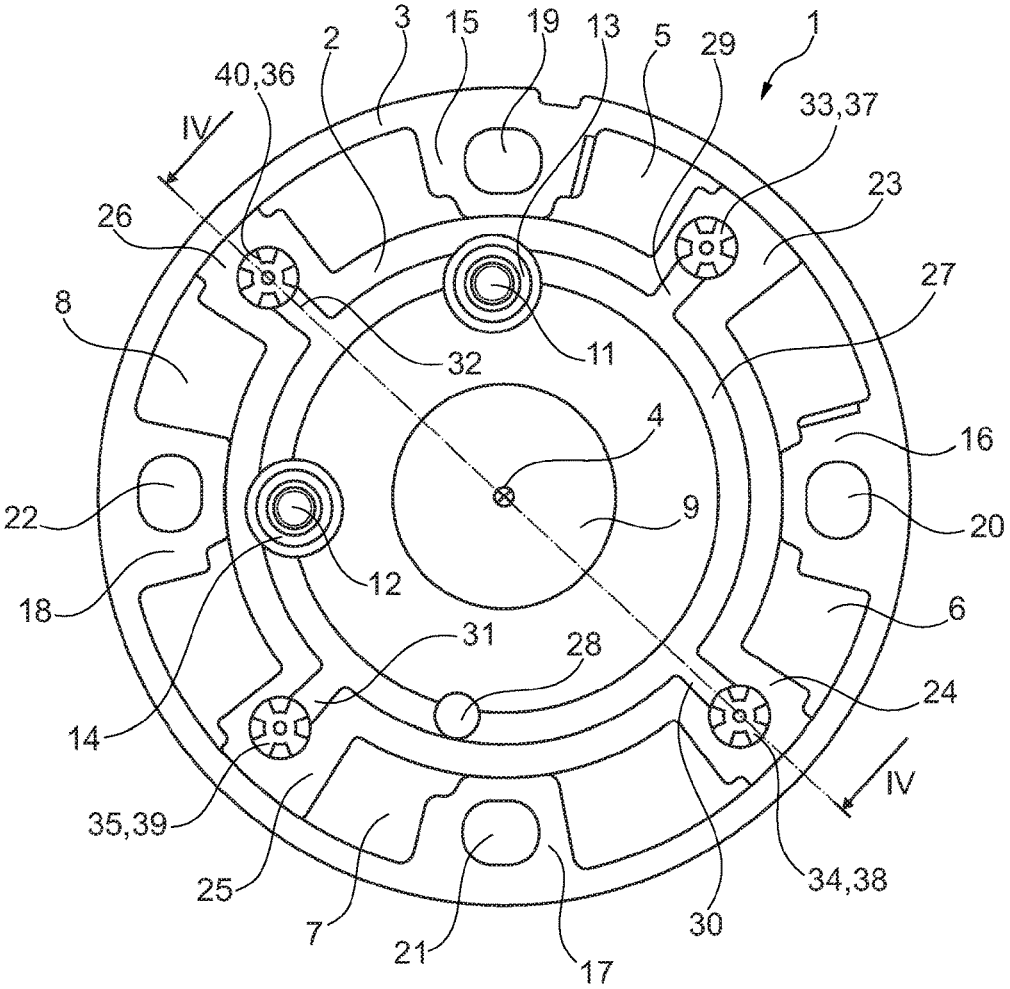
FIG. 1 shows a top view onto one specific embodiment of a camshaft adjuster according to the present invention, without a cover.

The figures are merely schematic, and are used only for an understanding of the present invention. Identical elements are provided with the same reference numerals. Details of the various exemplary embodiments may also be combined and/or exchanged with one another.

FIG. 1 shows a camshaft adjuster 1 according to the present invention in a top view, without a cover. Camshaft adjuster 1 is used for adjusting the rotation angle of a camshaft, not shown, with respect to the crankshaft of an internal combustion engine. The gas exchange valves of the internal combustion engine are actuated with the aid of the camshaft. The optimum valve timing changes with the engine speed. For the intake valves, the timing is retarded with increasing engine speed, and for the exhaust valves it is advanced. For engines having separate camshafts for the intake valves and exhaust valves, there is the option of easily achieving the desired speed-dependent adaptation of the timing by appropriately rotating the camshafts.

Camshaft adjuster 1 includes a rotor 2 and a stator 3 which are concentrically rotatable about a rotation axis 4 of camshaft adjuster 1, and rotatable relative to one another about rotation axis 4. Vane cells 5, 6, 7, 8 are formed between rotor 2 and stator 3, and are to be acted on by hydraulic medium, for example pressure oil, in order to effectuate a relative rotation of rotor 2 and stator 3. The pressure oil is supplied to vane cells 5, 6, 7, 8 via hydraulic channels in rotor 2 via a central screw, not illustrated in the figures, which is situated in a central through opening 9 in rotor 2.

A cover 10 (see FIG. 4) is fixed to stator 3 on the front side, i.e., on the front surface shown in FIG. 1. The cover is used, among other things, to seal vane cells 5, 6, 7, 8 formed between rotor 2 and stator 3, and generally has a locking receptacle, in the illustrated case two locking receptacles, not illustrated in the figures. Locking pins 11, 12 are situated in recesses 13, 14, respectively, formed in rotor 2, and are accommodated in such a way that they are displaceable in the direction of rotation axis 4. When they are moved out from rotor 2 in the direction of cover 10 (out of the plane of the drawing in FIG. 1) in the so-called locking position, locking pins 11, 12 may engage with the locking receptacles formed in each case at that location, thus preventing rotation of rotor 2 relative to cover 10, and thus relative to stator 3 to which cover 10 is fixed.

As shown in FIG. 1, a stator segment 15, 16, 17, 18 is formed in each case between two adjacent vane cells 5, 6, 7, 8. A fastening hole 19, 20, 21, 22 is formed in each stator segment 15, 16, 17, 18, respectively. Rotor 2 includes four rotor vanes 23, 24, 25, 26. The cover is fixed to stator 3 via fastening elements, for example attached screws, which engage with fastening holes 19, 20, 21, 22. Each rotor vane 23, 24, 25, 26 divides one vane cell into subvane cells.

An essentially ring-shaped hydraulic channel or C channel, referred to below as a ring channel 27, is formed in the front surface of rotor 2 on the cover side. A hydraulic medium line 28 via which hydraulic medium, generally oil, is supplied from a hydraulic tank or a hydraulic pump to ring channel 27 via the central screw opens into the ring channel. Hydraulic line 28 is also used for discharging hydraulic medium from ring channel 27 when the conveying direction of the hydraulic pump is reversed, or the central screw (as a switch valve) is appropriately adjusted.

In the area of each rotor vane 23, 24, 25, 26, ring channel 27 is provided with a radially outwardly directed branch 29, 30, 31, 32 which leads to a discharge valve 33, 34, 35, 36, respectively. Discharge valves 33, 34, 35, 36 are situated in corresponding discharge channels 37, 38, 39, 40 formed in rotor 2, which are each fluidically connected to corresponding branch 29, 30, 31, 32.

In the area of locking pins 11, 12, ring channel 27 also has widened areas, so that these are acted on by the pressure of the hydraulic medium in ring channel 27. The locking pins are arbitrarily pretensioned, for example mechanically, in the direction of the cover, i.e., out of the plane of the drawing in FIG. 1, with the aid of a spring, not illustrated, or hydraulically. If a relatively high pressure acts in ring channel 27, for example with the engine switched on, locking pins 11, 12 are pushed away from cover 10 by this pressure, against their pretension (into the plane of the drawing in FIG. 1), into their respective recess 13, 14 in rotor 2. When the pressure present in ring channel 27 drops below a predetermined value, for example due to switching off the engine and a resulting outflow of hydraulic medium from ring channel 27 via hydraulic medium line 28, with the aid of the hydraulic pump or the central screw, locking pins 11, 12 due to their pretension are moved out of the particular recess 13, 14 in the direction of cover 10 and the locking receptacles formed therein, and engage with the locking receptacles and lock rotor 2 with respect to cover 10 which is fixed to stator 3.

Figure 4:
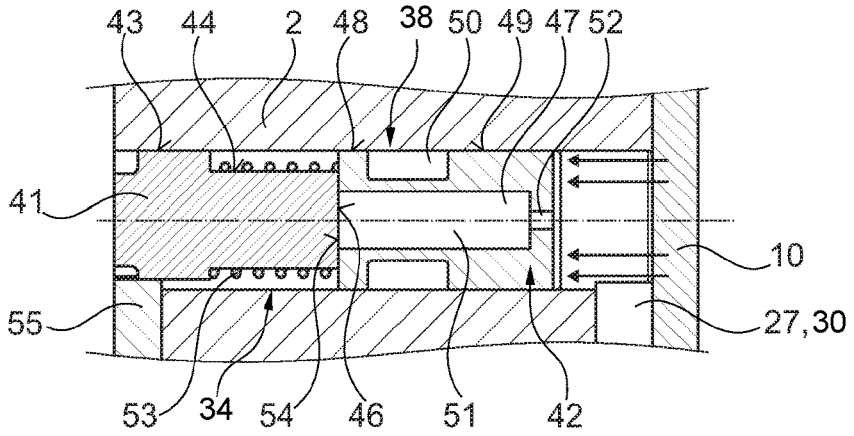
FIG. 4 shows a sectional view of the shut-off valve in parallel to the rotation axis of the camshaft adjuster, in the closed state.
Figure 5:
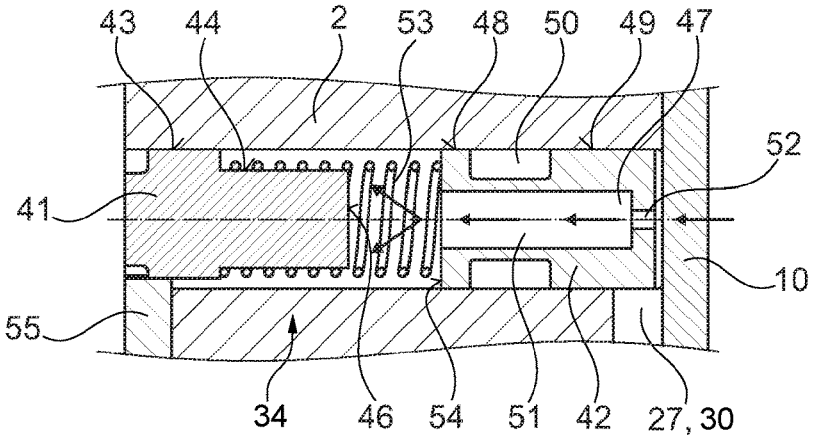
FIG. 5 shows a sectional view of the shut-off valve in parallel to the rotation axis of the camshaft adjuster, in the open state.
Figure 6:
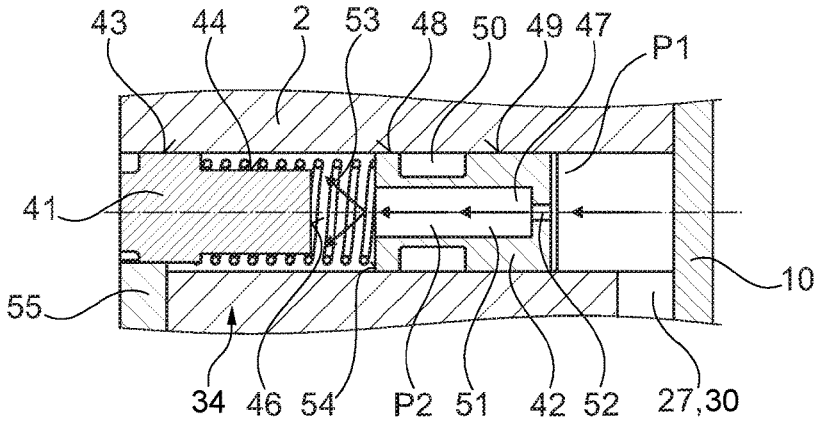
FIG. 6 shows a sectional view of the shut-off valve in parallel to the rotation axis of the camshaft adjuster during closing, between the open position of FIG. 5 and the closed position of FIG. 4.

Discharge valve 34 is illustrated in cross section in various functional positions by way of example for all mentioned discharge valves in FIGS. 4, 5, and 6. The location of the section is denoted by reference character IV-IV in FIG. 1. The following description references only valve 34, but correspondingly applies for remaining discharge valves 33, 35, 36 and the functional elements which cooperate with them in each case.

Figure 2:
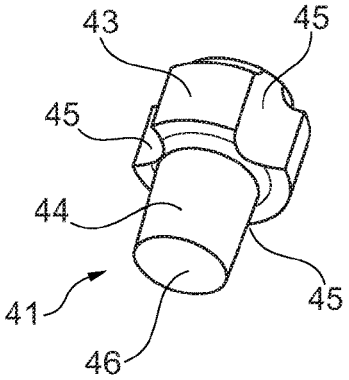
FIG. 2 shows a perspective view of a cartridge of a shut-off valve of a camshaft adjuster according to the present invention.
Figure 3:
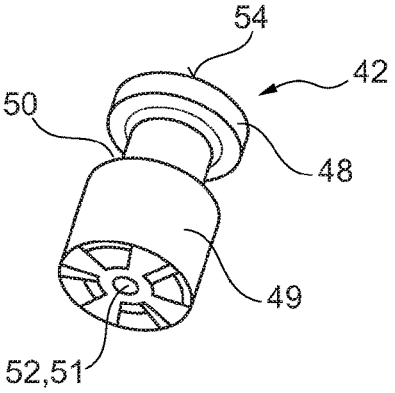
FIG. 3 shows a perspective view of a valve body of a shut-off valve of a camshaft adjuster according to the present invention.

Discharge valve 34 is situated in discharge channel 38, and includes a cartridge 41 and a valve body 42, also referred to as a hollow pin (see FIGS. 2 and 3). Cartridge 41 has an essentially cylindrical design, and includes a seating section 43 as well as an end section 44 having a smaller diameter than seating section 43. Three continuous flow recesses 45 situated in succession in the circumferential direction and passing through in the direction of discharge channel 38 are introduced into seating section 43. Front surface 46 of the cartridge facing away from seating section 43 is implemented as a sealing surface, and forms a valve seat on which valve body 42 may come to rest in a sealing manner.

Valve body 42 has an essentially hollow cylindrical design with a central through hole 47 and two sliding bearing sections 48, 49. A circumferential groove 50 is introduced between sliding bearing sections 48, 49, and opens or closes an opening or transverse borehole (not illustrated in the figures) formed in rotor 2, depending on the position of valve body 42. Valve body 42 may take on a locking function if necessary. The sectional illustrations in FIGS. 4, 5, and 6 clearly show a central hole 51 which completely passes through valve body 42. On the side facing away from cartridge 41, valve body 42 includes a diaphragm 52 having an opening cross section that is smaller than hole 51. The function of diaphragm 52 is provided in the description of FIGS. 4, 5, and 6.

Cartridge 41 and valve body 42 are axially situated in succession in discharge channel 38. With the aid of its seating section 42, cartridge 41 is pressed/guided into discharge channel 38. With the aid of its sliding bearing sections 48, 49, valve body 42 is displaceably supported in discharge channel 38 in the longitudinal direction of the discharge channel, and is pretensioned with respect to cartridge 41 in the direction of cover 10 (to the right in FIGS. 4, 5, and 6) with the aid of a compression spring 53. A discharge passage 55 to a hydraulic tank or the like is situated on the left side of discharge valve 34, as shown in FIGS. 4, 5, and 6. Ring channel 27 is shown on the right side of discharge valve 34 in FIGS. 4, 5, and 6. Front surface 54 of valve body 42 at the left in FIGS. 2, 3, and 4 is designed as a sealing surface which may come into sealing contact with front surface 46 of cartridge 41.

Figure 7:
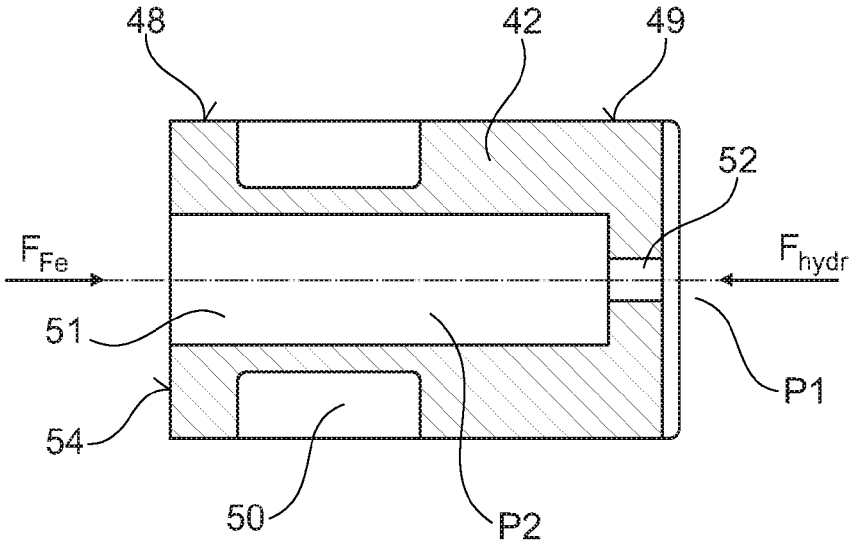
FIG. 7 shows a schematic illustration of the forces acting on the valve body.

The function of discharge valve 34 is explained below by way of example for all discharge valves 33, 34, 35, 36 with reference to FIGS. 4, 5, 6, and 7, the forces acting on the valve body being schematically illustrated in FIG. 7. FIG. 4 depicts the function of discharge valve 34 in the closed state. The side of valve body 42 opposite from sealing surface 54 is acted on by hydraulic medium via ring channel 27. In the illustration in FIG. 4, the hydraulic pressure acts on valve body 42 from the right side. The pretension force exerted by spring 53 on valve body 42 acts on the opposite side (left side). Hydraulic force $F_{hydr}$ acting on valve body 42 due to the oil pressure in channel 27 is greater than pretension force $F_{Fe}$ of spring 53, so that valve body 42 is pressed against cartridge 41 (to the left in FIG. 4), where it strikes against valve seat 46 and comes to rest on sealing surfaces 46 and 54 in a sealing manner. Ring channel 27 is thus separated from the tank via sealing surfaces 46 and 54 between valve body 42 and cartridge 41.

FIG. 5 depicts the function of discharge valve 34 during opening or in the open state. When ring channel 27 is switched to the tank via the central valve, i.e., a flow connection from ring channel 27 to the tank via hydraulic medium line 28 is established, the pressure in ring channel 27 drops. If the pressure drops below a predetermined limiting value, hydraulic force $F_{hydr}$ becomes smaller than elastic force $F_{Fe}$ due to the lower pressure. As a result, valve body 42 is moved against the pressure in ring channel 27 (to the right in FIG. 5). A flow path is thus opened in discharge valve 34 which leads from branch 30 of ring channel 27 through diaphragm 52 and central hole 51, along the outside of end section 44, through flow recesses 45 of cartridge 41 to discharge passage 55. An additional connection from ring channel 27 to the tank is thus opened, through which the hydraulic medium may flow through the hollow valve body to the tank. Due to the provision according to the present invention of multiple additional discharge valves 33, 34, 35, 36, the pressure drop in ring channel 27 takes place very quickly, so that the pressure acting on locking pins 11, 12 is reduced very quickly, and the locking pins, due to the pretension acting on them, may arrive at the position in which rotor 2 is locked with the cover, at the required high speed.

FIG. 6 depicts the function of discharge valve 34 during the closing operation. A defined volume flow of hydraulic medium in ring channel 27 is provided by an engine oil pump, not illustrated. This volume flow initially passes through open discharge valve 34 via the above-described flow path, back to the tank. Due to diaphragm 52, as a result of the volume flow a pressure $P_2$ builds up in front of the diaphragm (indicated in FIG. 7). Pressure $P_2$ is a function of the volume flow. The higher the volume flow passing through diaphragm 52, the greater is pressure $P_2$.

Diaphragm 52 throttles the volume flow, so that pressure $P_1$ (indicated in FIG. 7) behind diaphragm 52 is always less than pressure $P_2$. Consequently, a resultant pressure force $F_{hydr}$ which is directed opposite the pretension force of spring 53 acts on valve body 42. When there is sufficient volume flow, resultant pressure force $F_{hydr}$ is greater than pretension force $F_{Fe}$ of spring 53, so that valve body 42 moves against the elastic force and strikes against cartridge 41. As a result, discharge channel 38 and thus the connection from ring channel 27 to the tank are closed. A higher pressure builds up in flow channel 27 which pushes locking pins 11, 12 out of the respective locking receptacle of cover 10 in the direction of rotor 2, thus unlocking the camshaft adjuster.

LIST OF REFERENCE NUMERALS

1 camshaft adjuster
2 rotor
3 stator
4 rotation axis/longitudinal axis
5-8 vane cell
9 central through opening
10 cover
11 locking pin
12 locking pin
13 recess
14 recess
15-18 stator segment
19-22 fastening hole
23-26 rotor vane
27 ring channel
28 hydraulic line
29-32 branch
33-36 discharge valve
37-40 discharge channel
41 cartridge
42 valve body
43 seating section
44 end section
45 flow recesses
46 front surface
47 central through hole
48 sliding bearing section
49 sliding bearing section
50 groove
51 central hole
52 diaphragm
53 compression spring
54 sealing surface
55 tank channel
$P_1$ pressure behind the diaphragm
$P_2$ pressure in front of the diaphragm

The invention claimed is:

1. A hydraulic camshaft adjuster comprising:

a rotor and a stator supported rotatably relative to one another;

a cover fixed to the stator and including a locking receptacle;

at least one locking pin accommodated in the rotor in such a way that the at least one locking pin is displaceable in the axial direction, and is pretensioned with pretension in a direction of the locking receptacle;

a hydraulic channel for acting with pressure on the at least one locking pin against the pretension, and fillable with a hydraulic medium emptiable via a central screw; and at least one additional discharge channel fluidically connected to the hydraulic channel and including a discharge valve formed in the rotor, wherein the discharge valve includes a valve seat fixed in the rotor, and a valve body movable with respect to the valve seat including a flow path, wherein the discharge valve includes a cartridge fixed in the at least one additional discharge channel and forms the valve seat.

2. The hydraulic camshaft adjuster as recited in claim 1 wherein the discharge valve is integrated in such a way that the discharge valve closes the at least one additional discharge channel when the at least one locking pin is acted on by hydraulic pressure, and opens the at least one additional discharge channel when the hydraulic pressure acting on the at least one locking pin drops, or the discharge valve is a shut-off valve and is situated in the at least one additional discharge channel in the rotor.

3. The hydraulic camshaft adjuster as recited in claim 1 wherein the hydraulic channel is formed in the rotor or in the cover, and forms a flow path for hydraulic medium through the rotor from a supply line to the at least one locking pin, and from the at least one locking pin to the discharge valve and to the at least one additional discharge channel.

4. The hydraulic camshaft adjuster as recited in claim 1 wherein the hydraulic channel is a ring channel leading from a supply line via the at least one locking pin back to the supply line.

5. The hydraulic camshaft adjuster as recited in claim 1 wherein the valve body includes a diaphragm whose axial width is less than an axial length of the valve body, or whose flow cross-sectional area is less than a flow cross-sectional area of the flow path.

6. The hydraulic camshaft adjuster as recited in claim 1 wherein the valve body is pretensioned into an open position, the at least one additional discharge channel being open in the open position, via a compression spring.

7. The hydraulic camshaft adjuster as recited in claim 1 wherein the valve body is provided with a through hole.

8. The hydraulic camshaft adjuster as recited in claim 1 wherein the discharge valve is a shut-off valve and the cartridge has at least one recess forming a flow path for hydraulic medium through the at least one additional discharge channel when the shut-off valve is open.

* * * * *